US011931619B2

(12) United States Patent
Jackson

(10) Patent No.: US 11,931,619 B2
(45) Date of Patent: Mar. 19, 2024

(54) ALL-IN-ONE WORKOUT SOLUTION

(71) Applicant: Nicole Jackson, Tucson, AZ (US)

(72) Inventor: Nicole Jackson, Tucson, AZ (US)

( * ) Notice: Subject to any disclaimer, the term of this patent is extended or adjusted under 35 U.S.C. 154(b) by 111 days.

(21) Appl. No.: 17/544,777

(22) Filed: Dec. 7, 2021

(65) Prior Publication Data

US 2023/0173324 A1 Jun. 8, 2023

(51) Int. Cl.
*A63B 21/072* (2006.01)
*A63B 21/00* (2006.01)

(52) U.S. Cl.
CPC ..... *A63B 21/0722* (2015.10); *A63B 21/0726* (2013.01); *A63B 21/0728* (2013.01); *A63B 21/4035* (2015.10)

(58) Field of Classification Search
CPC ..... A63B 21/0722; A63B 21/0726; A63B 21/0728; A63B 21/4035; A63B 21/072; A63B 21/0004; A63B 21/00058; A63B 21/00061; A63B 21/00065
See application file for complete search history.

(56) References Cited

U.S. PATENT DOCUMENTS

| | | | | |
|---|---|---|---|---|
| 8,568,280 | B2 * | 10/2013 | Mendoza | A63B 21/0722 482/93 |
| 9,770,619 | B1 * | 9/2017 | Bullock | A63B 65/06 |
| 9,844,695 | B1 * | 12/2017 | Shorter | A63B 21/075 |
| 2007/0135274 | A1 * | 6/2007 | Blateri | A63B 21/075 482/109 |
| 2008/0081744 | A1 * | 4/2008 | Gormley | A63B 21/0728 482/93 |
| 2014/0194258 | A1 * | 7/2014 | Shorter | A63B 21/072 482/93 |
| 2016/0256730 | A1 * | 9/2016 | Bartos | A63B 21/072 |

* cited by examiner

*Primary Examiner* — Megan Anderson
(74) *Attorney, Agent, or Firm* — The Rapacke Law Group, P.A.; Andrew S. Rapacke

(57) ABSTRACT

A modular workout solution may include at least one hemisphere constructed and arranged to securely attach to a handle, a cap, an ab roller assembly, or dumbbell or barbell shaft to provide a modular solution adaptable for various exercise or workout programs and routines. The hemisphere may include recesses constructed and arranged for housing modular weights such that the weight of the modular workout solution is customizable. Multiple hemispheres may be combinable to increase weight or construct dumbbells, barbells, kettlebells, medicine balls, pylons, ab rollers, or the like.

20 Claims, 6 Drawing Sheets

ALL-IN-ONE WORKOUT SOLUTION

TECHNICAL FIELD

The embodiments generally relate to modular exercise equipment.

BACKGROUND

Exercise equipment may be used to improve aerobic or anaerobic function or strength or aid with physical rehabilitation. Commonly used equipment may include a variety of equipment including dumbbells, barbells, free weights, kettle bells, or the like. Commercial gym offerings may include dozens or hundreds of said equipment at high cost. Dumbbells, barbells, free weights, and kettle bells may require large volumes of space for storage in use.

Modular exercise equipment, such as dumbbells having selectable or modular weight functionality may reduce the required space for storage and use but are not a complete replacement for dumbbells, barbells, free weights, and kettle bells.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments relate to a modular workout solution that may function as a complete replacement for a variety of dumbbells, barbells, free weights, and kettle bells.

The embodiments relate to a modular workout solution that may also function as a strength and conditioning device for enhancing exercises such as chest press, ab rolling, aerobic exercises, and anaerobic exercises.

The embodiments relate to a modular workout solution that may function as a wide variety of exercise equipment in a single unit including, but not limited to, a medicine ball, a two handled kettlebell, a kettlebell, pushup or chest press assistant, barbell, dumbbell, ab roller, or pylon.

The embodiments relate to a modular workout solution that may include smart enabled systems and functionality within at least one of the first hemisphere or the second hemisphere, the smart enabled assembly being constructed and arranged for monitoring and tracking user interactions with the modular workout solution and communicating said monitoring and tracking to a smart device such as a smart phone via a software application in operable communication with the smart enabled assembly.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
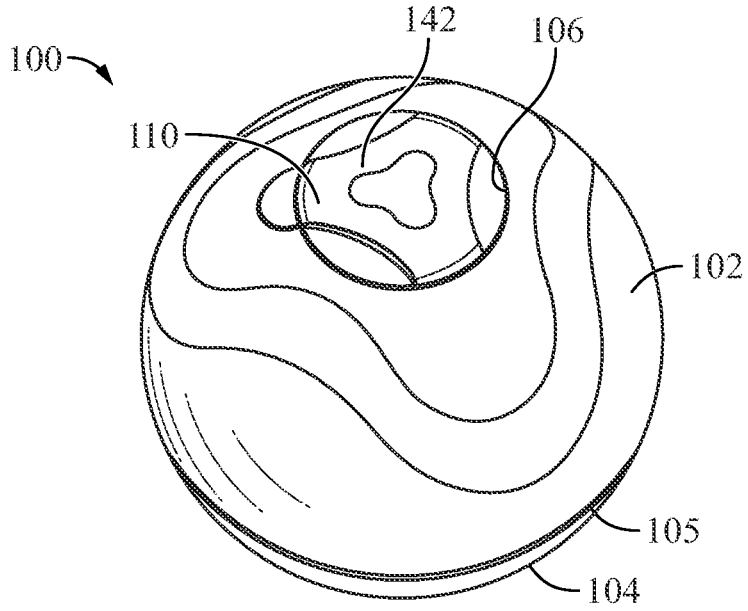
FIG. 1 illustrates a view of a modular workout solution as a medicine ball consistent with this disclosure.

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

In general, the embodiments provided herein relate to a modular workout solution including at least one hemisphere constructed and arranged to securely attach to a handle, a cap, an ab roller assembly, or dumbbell or barbell shaft to provide a modular solution adaptable for various exercises or workout programs and routines.

Multiple hemispheres may be connected to one another via various attachment assemblies as will be described. Similarly, hemispheres may be attached to various handles, caps, or modular weights via various assemblies as will be described. Hemispheres may be constructed and arranged to securely receive modular weights therein such that users may vary the weight and resistance of the modular workout solution according to their needs.

According to some embodiments, an attachment assembly may secure the first hemisphere to the second hemisphere and may facilitate securing of the modular weights within recesses defined by the first atmosphere and second hemisphere. The attachment assembly may also include a shaft or bar portion of varying length such that the modular workout solution may function as a medicine ball having a first hemisphere abutting a second hemisphere such that the modular workout solution is adapted for use by a user gripping the first and second hemispheres. Alternatively, the modular workout solution may be constructed and arranged to function as a barbell or dumbbell where in the first hemisphere and second hemisphere may be distanced from one another, the shaft being disposed there between, such that the modular workout solution is adapted for use by a user by gripping the shaft.

Referring to FIG. 1, a modular workout solution 100 may include a first hemisphere 102 and a second hemisphere 104 defining a split seam 105 there between to form a workout solution such as a medicine ball. Each of the first and second hemispheres may be made up of any suitable material such as, but not limited to, a polymer, metal, rubber, or the like. According to some embodiments, each of the first and second hemispheres may include composite arrangements of materials. According to some variations, each of the first and second hemispheres may incorporate decorative elements or images thereon. The modular workout solution 100 may include an attachment assembly 142 disposed within an attachment through hole 106 defined by the first hemisphere 102 or second hemisphere 104 and including an attachment cap 110 constructed and arranged to seat within the attachment through hole 106 and lockingly engage with the attachment assembly 142. The attachment assembly 142 may be constructed and arranged to secure the first hemisphere 102 to a second hemisphere 104, or as will be seen in the following description of figures, various other arrangements such as modular weights, caps, handles, shafts, or other arrangements.

Figure 2:
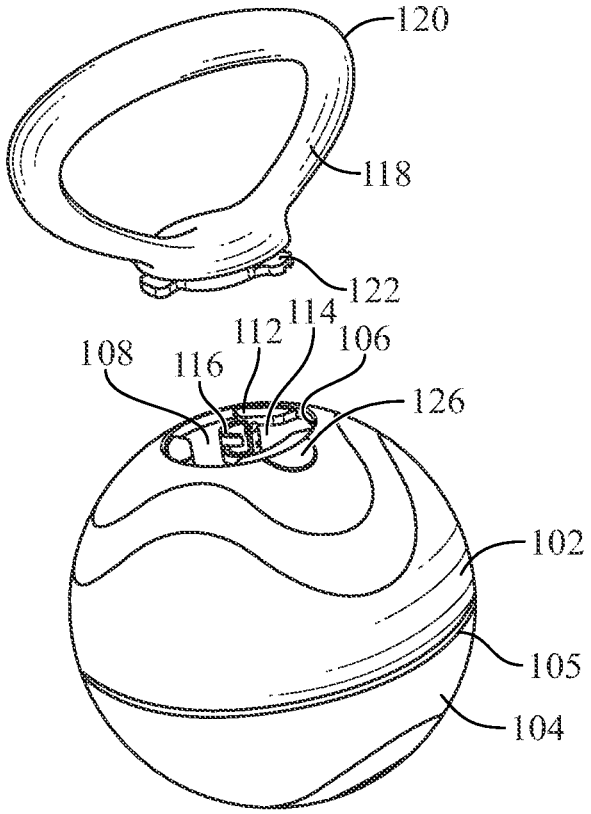
FIG. 2 illustrates a partially exploded view of a modular workout solution as a kettlebell consistent with this disclosure.

Referring to FIG. 2, a modular workout solution in a dual hemisphere kettlebell arrangement may include a first hemisphere 102 and a second hemisphere 104 defining a split seam 105 there between to form a workout solution such as a kettlebell. The modular workout solution may include a smart enabled assembly 108 constructed and arranged for monitoring and tracking user interactions with the modular workout solution. The smart enabled assembly may include various sensors, processors, memories, data storage systems and the like, as needed, and corresponding software implemented on a smart device to track and interpret user behavior to increase workout efficacy, increase user performance, and improve exercise enjoyment. The attachment through hole 106 may include a plurality of attachment tabs 112 constructed and arranged for mechanically connecting to the attachment cap as seen in FIG. 1 or to various other components such as a kettlebell handle 118 including a handle 120 and a cap locking mechanism 122 constructed and arranged to mechanically mate with the attachment through hole 106 and attachment tabs 112. The kettle bell handle 118 may be further constructed and arranged to mechanically communicate with a spine locking mechanism 146 as part of the attachment assembly 142, constructed and arranged to facilitate attachment of the handle 118, first hemisphere 102, and second hemisphere 104. The attachment assembly 142 may further include an attachment lock 126 integrated with either the first hemisphere 102 or second hemisphere 104 or both. The attachment lock 126 that may be constructed and arranged to secure the attachment cap or kettle bell handle 118 within the attachment through hole 106 such that in order to remove the cap or handle, the attachment lock to 126 must be disengaged prior to removing the cap or handle.

Figure 3:
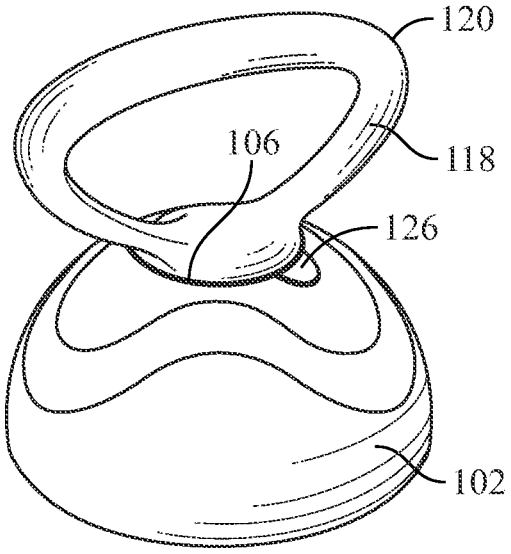
FIG. 3 illustrates a view of a modular workout solution as a kettlebell consistent with this disclosure.

Referring to FIG. 3, a modular workout solution in a single hemisphere kettlebell arrangement may include a first hemisphere 102 and a kettlebell handle 118 mechanically connected to the attachment through hole 106 and attachment assembly and lockingly engaged with the attachment lock 126 such that the modular workout solution may be used as a single handle 120, single hemisphere kettlebell.

Figure 4:
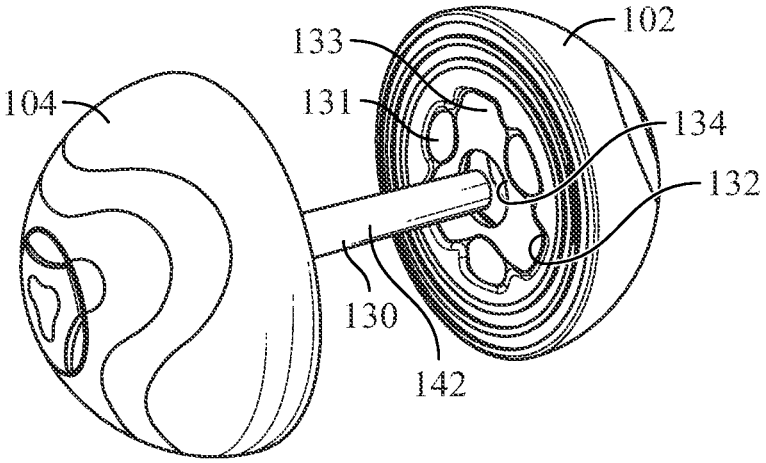
FIG. 4 illustrates a view of a modular workout solution as a dumbbell consistent with this disclosure.

Referring to FIG. 4, a modular workout solution in a dumbbell arrangement may include a first hemisphere 102 opposite a second hemisphere 104, and an attachment assembly 142 having a dumbbell handle 130 disposed there between. The attachments assembly 142 may include a dumbbell handle 130 and at least one flange 134 for mechanically connecting the attachment assembly 142 to the first hemisphere 102 and the second hemisphere 104. Disposed between the attachment assembly and each hemisphere may be a first modular weight 131 or a second modular weight 133 seated within a weight recess 132 defined by the first hemisphere 102. Second hemisphere 104 may define a similar weight recess constructed and arranged to lockingly seat modular weights therein. Modular weights 131 and 133 are best seen in FIGS. 5, 6, and 7.

Figure 5:
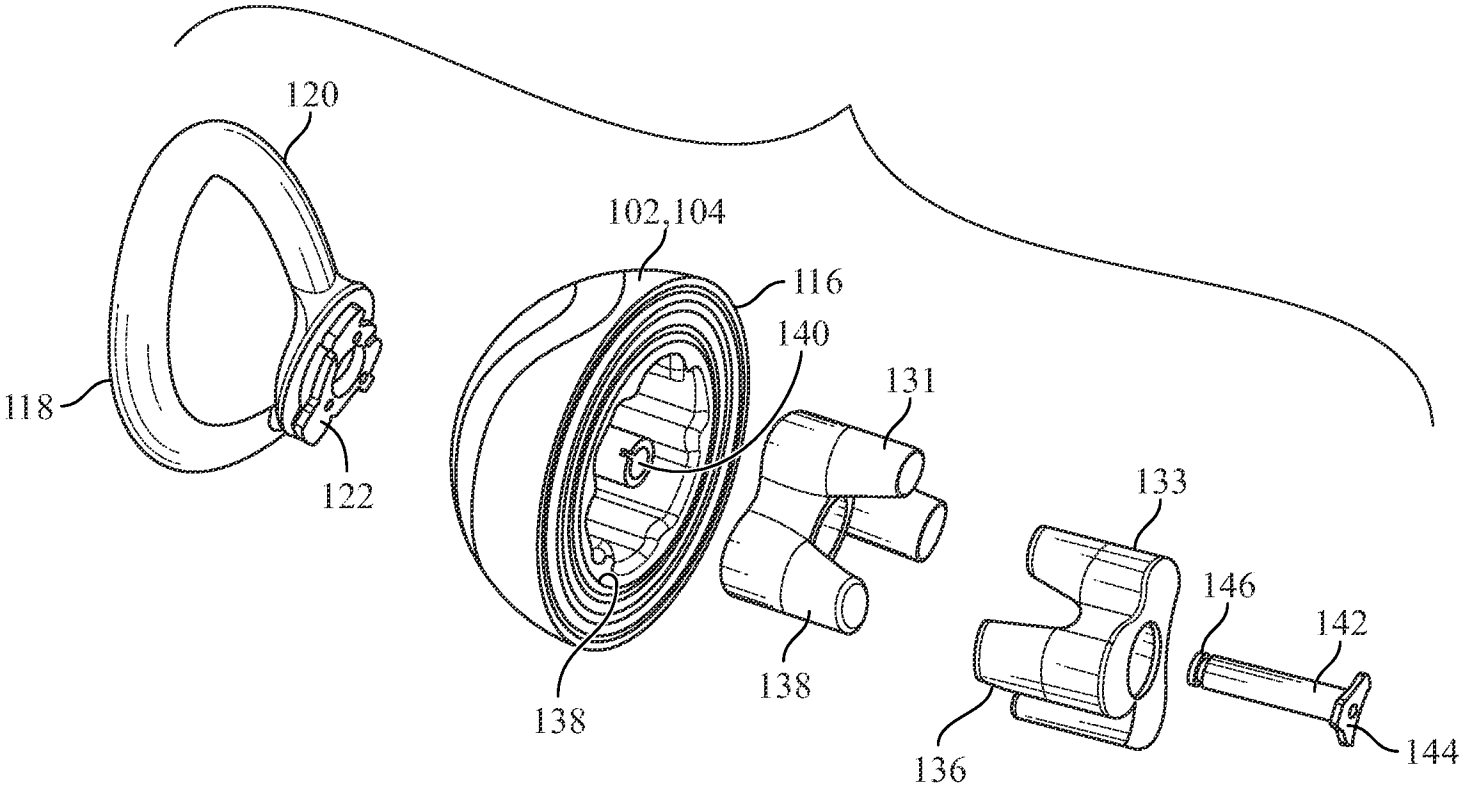
FIG. 5 illustrates an exploded view of a modular workout solution as a kettlebell consistent with this disclosure.

Referring to FIG. 5, a modular workout solution in a single hemisphere kettlebell arrangement may include first hemisphere 102 defining a split seam 105 and a modular weight recess 132 and having a hollow spine sleeve 140. An attachment assembly 142 may include a locking mechanism 146 and a flange 144 constructed and arranged for slidably engaging with the spine sleeve 140 to secure modular weights 131 and 133 within the modular weight recess 132. The hollow spine sleeve 140 may be in operable communication with the attachment through hole. According to some variations, the modular weights 131 and 133 may include protrusions 136 and 138 constructed and arranged to mechanically engage with one another when inserted within the modular weight recess 132. The attachment assembly 142 may mechanically connect to the to the first hemisphere 102 or second hemisphere 104 by passing through and being disposed within a portion of at least the first modular weight 131, second modular weight 133, hollow spine sleeve 140, or cap locking mechanism 122 as well as mechanically connect to a cap or kettle bell handle 118 via a spine locking mechanism 146. The attachments assembly 142 may include a flange 144 constructed and arranged to bias the modular weights within the modular weight recess when the attachment assembly 142 is secured within the modular workout solution.

Figure 6:
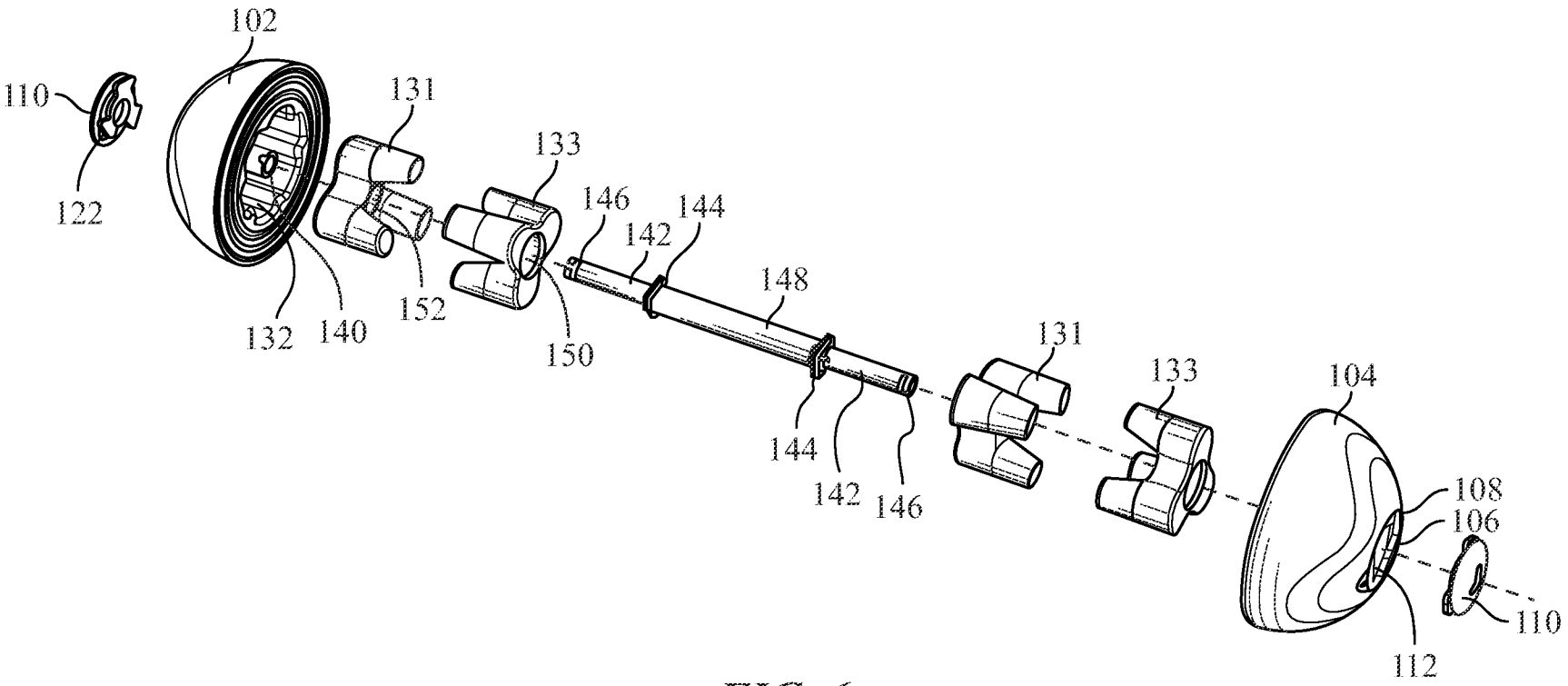
FIG. 6 illustrates an exploded view of a modular workout solution as a dumbbell or barbell consistent with this disclosure.

Referring to FIG. 6, a modular workout solution in a dumbbell or barbell arrangement may include a first hemisphere 102 opposite a second hemisphere 104. Each of the first hemisphere and second hemisphere may define a respective modular weight recess 132, and may include a spine sleeve 140, an attachment cap 110, and a cap locking mechanism 122 constructed and arranged to mate with an attachment assembly 142 including a spine locking mechanism 146 connected to a flange 144 and shaft 148. The attachment assembly 142 and spine locking mechanism 146 may be constructed and arranged to pass through a first weight through hole 150 defined by a modular weight 133 and a second way through hole 152 defined by modular weight 131 and mechanically engage with the spine sleeve 140 and cap locking mechanism 122 in the cap 110. In this way, a first hemisphere 102 having modular weights 131 and 133 disposed therein may be securely connected to the shaft 148. Similarly, a second hemisphere 104 having modular weights 131 and 133 disposed therein may be securely connected to the shaft 148. The shaft 148 may be of any length and diameter appropriate for the module workout solution described herein. The shaft 148 may, according to some examples, may include a handle portion approximately 4 to 8 inches in length and one to two inches in diameter such that it may be easily gripped by the hand and function as a dumbbell. The shaft 148 may alternatively be long enough to facilitate the use of the modular workout solution as a barbell. The shaft 148 may include coatings or knurling appropriate for enhancing a user's grip on the shaft.

Figure 7:
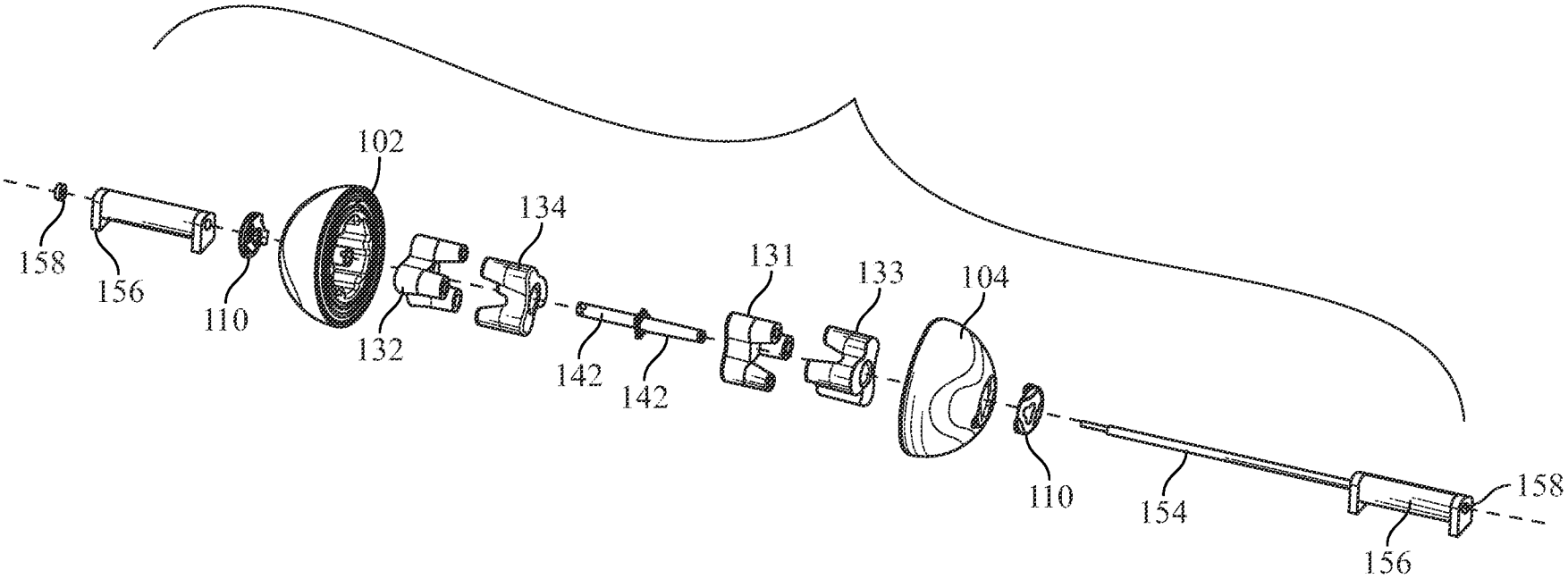
FIG. 7 illustrates an exploded view of a modular workout solution as an ab roller consistent with this disclosure.

Referring to FIG. 7, a modular workout solution in an ab roller arrangement may include first hemisphere 102 opposite a second hemisphere 104, a plurality of modular weights 132, 134, and an attachment assembly 142 disposed there between to facilitate the attachment of the attachment assembly 142, modular weights 131, 133, first hemisphere 102, second hemisphere 104, and end caps 110. An ab roller assembly may include a roller shaft 154 that may be constructed and arranged to pass through a portion of end cap 110, hemispheres 102 and 104, modular weights 131 and 133, and attachment assembly 142. The roller shaft 154 may be constructed and arranged to rotate freely within each of the end cap 110, hemispheres 102 and 104, modular weights 131 and 133, and attachment assembly 142. A roller handle 156 may be disposed on the roller shaft 154 on each side of the first hemisphere 102 and second hemisphere 104. The roller handle 156 may be constructed and arranged to rotate freely on the roller shaft 154. A mechanical connector 158 may be disposed on each end of the roller shaft 154 to secure the modular workout solution in an ab roller arrangement. In practice and in use, a user may place their hands on each of the roller handles 156 and roll the modular workout station along the floor in order to extend their body and strengthen various muscles including the abdominal muscles.

Figure 8:
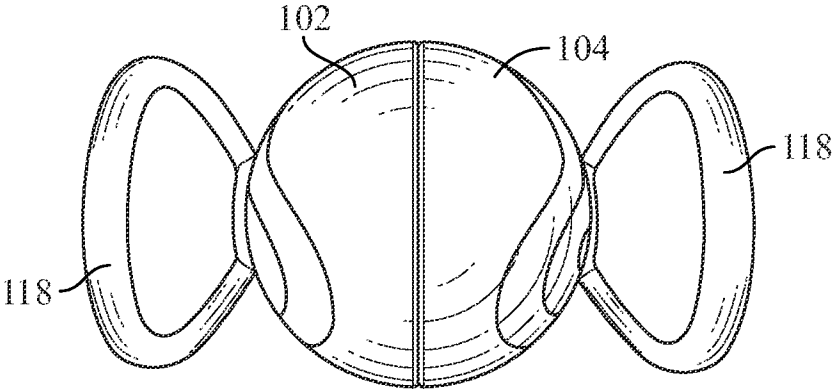
FIG. 8 illustrates a view of a modular workout solution as a two-handled weight or medicine ball consistent with this disclosure.

Referring to FIG. 8, a modular workout solution in a two handled weight or kettlebell arrangement may include a first hemisphere 102, a second hemisphere 104, and two handles 118 affixed to the first hemisphere 102 and second hemisphere 104 respectively. Modular weights as previously described may be selectively disposed within the modular workout solution.

Figure 9:
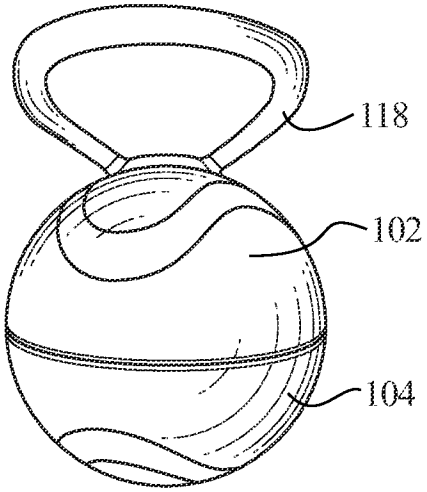
FIG. 9 illustrates a view of a modular workout solution as a kettlebell consistent with this disclosure.

Referring to FIG. 9, a modular workout solution In a kettlebell arrangement may include first hemisphere 102, a second hemisphere 104, and a single handle 118 affixed to the assembly of the first hemisphere and second hemisphere. Modular weights as previously described may be selectively disposed within the modular workout solution.

Figure 10:
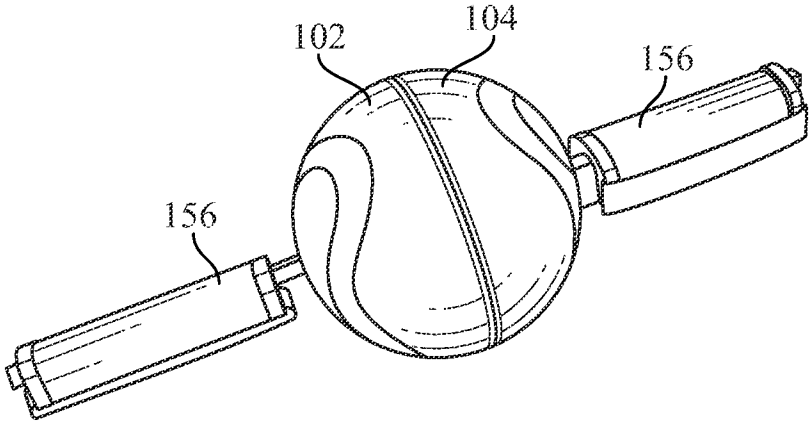
FIG. 10 illustrates a view of a modular workout solution as an ab roller consistent with this disclosure.

Referring to FIG. 10, a modular workout solution In an ab roller arrangement may include a first hemisphere 102 and a second hemisphere 104 disposed between two roller handles 156 having a roller shaft 154 passing through the modular workout solution and secured by mechanical connectors. Modular weights as previously described may be selectively disposed within the modular workout solution.

Figure 11:
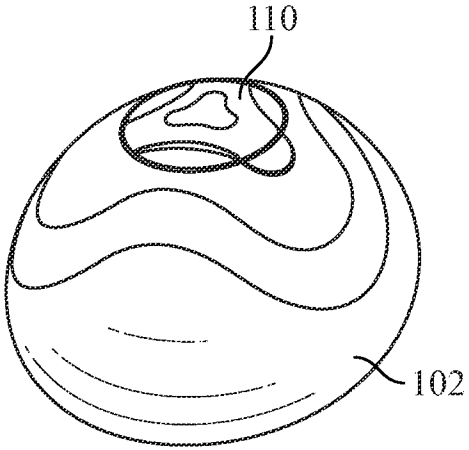
FIG. 11 illustrates a view of a modular workout solution as a pylon consistent with this disclosure.

Referring to FIG. 11, a modular workout solution in a pylon arrangement may include the first hemisphere 102 connected to an end cap 110 and optionally including modular weights disposed therein.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a modular workout solution may include a first hemisphere including a first hollow spine sleeve and defining a first attachment through hole in communication with the first hollow spine sleeve, the first hemisphere further defining a first modular weight recess constructed and arranged to seat at least one modular weight therein; and an attachment assembly disposed within the first hollow spine sleeve and the attachment through hole, the attachment assembly being constructed and arranged to secure to the first hemisphere.

Variation 2 may include a modular workout solution as in variation 1, further including a first attachment cap constructed and arranged to seat within the first attachment through hole and securely attach to the attachment assembly and the first hemisphere.

Variation 3 may include a modular workout solution as in any of variations 1 through 2, further including a second hemisphere including a second hollow spine sleeve and defining a second attachment through hole in communication with the second hollow spine sleeve, the second hemisphere further defining a second modular weight recess constructed and arranged to seat at least one modular weight therein; and wherein the attachment assembly is disposed within the first hollow spine sleeve, second hollow spine sleeve, first attachment through hole, and second attachment through hole, the first attachment assembly and second attachment assembly being constructed and arranged to secure to the first hemisphere and second hemisphere.

Variation 4 may include a modular workout solution as in any of variations 1 through 3, further including a second attachment cap constructed and arranged to seat within the second attachment through hole and securely attach to the attachment assembly and the second hemisphere.

Variation 5 may include a modular workout solution as in any of variations 1 through 4, further including at least one modular weight.

Variation 6 may include a modular workout solution as in any of variations 1 through 5, wherein the attachment assembly includes at least one locking mechanism and at least one flange constructed and arranged for slidably engaging with at least one of the first hollow spine sleeve or second hollow spine sleeve to secure at least one modular weight within at least one of the first modular weight recess or second modular recess.

Variation 7 may include a modular workout solution as in any of variations 1 through 6, wherein the at least one modular weight is a plurality of modular weights may each include a plurality of protrusions constructed and arranged to mechanically engage with one another when seated within at least one of the first modular weight recess or second modular weight recess.

Variation 8 may include a modular workout solution as in any of variations 1 through 7, wherein the attachment assembly includes a first locking mechanism attached to a first flange, a second locking mechanism attached to a second flange, and a shaft attached to and disposed between the first flange and second flange, the attachment assembly being constructed and arranged for slidably engaging with at least one of the first hollow spine sleeve or second hollow spine sleeve to secure at least one modular weight within at least one of the first modular weight recess or second modular recess.

Variation 9 may include a modular workout solution as in any of variations 1 through 8, wherein the shaft has at least one of a coating or knurling adapted for enhancing a user's grip on the shaft.

Variation 10 may include a modular workout solution as in any of variations 1 through 9, further including an attachment lock integrated with at least one of the first hemisphere or second hemisphere, the attachment lock being constructed and arranged to secure the attachment cap or kettle bell handle within the attachment through hole such that the attachment lock must be depressed prior to removing the cap or handle.

Variation 11 may include a modular workout solution as in any of variations 1 through 10, further including an ab roller assembly including a roller shaft disposed within the attachment assembly, first hemisphere, and second hemisphere; at least one first roller handle rotatably disposed on the roller shaft; and at least one mechanical connecter securing the at least one first roller handle to the roller shaft.

Variation 12 may include a modular workout solution as in any of variations 1 through 11, further including a second roller handle rotatably disposed on the roller shaft.

Variation 13 may include a modular workout solution as in any of variations 1 through 12, further including at least one kettlebell handle constructed and arranged to seat within the first attachment through hole and securely attach to the attachment assembly and the first hemisphere.

Variation 14 may include a modular workout solution as in any of variations 1 through 13, further including an attachment lock integrated with at least one of the first hemisphere or second hemisphere, the attachment lock being constructed and arranged to secure the attachment cap or kettle bell handle within the attachment through hole such that the attachment lock must be depressed prior to removing the cap or handle.

According to variation 15, a modular workout solution may include a first hemisphere including a first hollow spine sleeve and defining a first attachment through hole in communication with the first hollow spine sleeve; a second hemisphere including a second hollow spine sleeve and defining a second attachment through hole in communication with the second hollow spine sleeve; and an attachment assembly disposed within the first hollow spine sleeve and second hollow spine sleeve and the first attachment through hole and the second attachment through hole, the attachment assembly being constructed and arranged to secure to the first hemisphere and second hemisphere.

Variation 16 may include a modular workout solution as in variation 15 wherein the first hemisphere further defines a first modular weight recess constructed and arranged to seat at least one modular weight therein; and the second hemisphere further defines a second modular weight recess constructed and arranged to seat at least one modular weight therein Variation 17 may include a modular workout solution as in any of variations 15 through 16 further including at least one modular weight constructed and arranged to be selectively disposed within at least one of the first modular weight recess or second modular weight recess.

Variation 18 may include a modular workout solution as in any of variations 15 through 17 further including a first attachment cap and a second attachment cap constructed and arranged to connectively seat within the first attachment through hole and second attachment through hole, respectively, and securely attach to the attachment assembly and the first hemisphere and second hemisphere.

Variation 19 may include a modular workout solution as in any of variations 15 through 18 wherein the attachment assembly includes an integrated shaft constructed and arranged to space the first hemisphere from the second hemisphere.

According to variation 20, a modular workout solution may include a first hemisphere including a first hollow spine sleeve and defining a first attachment through hole in communication with the first hollow spine sleeve, the first hemisphere further defining a first modular weight recess constructed and arranged to seat at least one first modular weight therein; a second hemisphere including a second hollow spine sleeve and defining a second attachment through hole in communication with the second hollow spine sleeve, the second hemisphere further defining a second modular weight recess constructed and arranged to seat at least one second modular weight therein; an attachment assembly including at least one flange disposed between a first locking mechanism and a second mechanism, the first locking mechanism being disposed within the first hollow spine sleeve and the second locking mechanism being disposed within second hollow spine sleeve, the attachment assembly being constructed and arranged to secure to the first hemisphere and second hemisphere; at least one smart enabled assembly disposed within at least one of the first hemisphere or the second hemisphere, the smart enabled assembly being constructed and arranged for monitoring and tracking user interactions with the modular workout solution and communicating said monitoring and tracking to a smart device; and wherein the at least one flange is constructed and arrange to secure the at least one first modular weight within the first modular weight recess and the at least one flange is constructed and arrange to secure the at least one second modular weight within the second modular weight recess.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A modular workout solution, comprising:

a first hemisphere comprising a first hollow spine sleeve and defining a first attachment through hole in communication with the first hollow spine sleeve, the first hemisphere further defining a first modular weight recess constructed and arranged to seat at least one modular weight therein; and an attachment assembly disposed within the first hollow spine sleeve and the attachment through hole, the attachment assembly being constructed and arranged to secure to the first hemisphere.

2. The modular workout solution as in claim 1, further comprising a first attachment cap constructed and arranged to seat within the first attachment through hole and securely attach to the attachment assembly and the first hemisphere.

3. The modular workout solution as in claim 2, further comprising:

a second hemisphere comprising a second hollow spine sleeve and defining a second attachment through hole in communication with the second hollow spine sleeve, the second hemisphere further defining the second modular weight recess constructed and arranged to seat at least one modular weight therein; and wherein the attachment assembly is disposed within the first hollow spine sleeve, second hollow spine sleeve, the first attachment through hole, and the second attachment through hole, the attachment assembly being constructed and arranged to secure to the first hemisphere and second hemisphere.

4. The modular workout solution as in claim 3, further comprising a second attachment cap constructed and arranged to seat within the second attachment through hole and securely attach to the attachment assembly and the second hemisphere.

5. The modular workout solution as in claim 4, further comprising the at least one modular weight.

6. The modular workout solution as in claim 5, wherein the attachment assembly comprises a first locking mechanism attached to a first flange, a second locking mechanism attached to a second flange, and a shaft attached to and disposed between the first flange and second flange, the attachment assembly being constructed and arranged for slidably engaging with at least one of the first hollow spine sleeve or the second hollow spine sleeve to secure the at least one modular weight within at least one of the first modular weight recess or the second modular recess.

7. The modular workout solution as in claim 6, further comprising an ab roller assembly comprising:

a roller shaft disposed within the attachment assembly, the first hemisphere, and the second hemisphere;

at least one first roller handle rotatably disposed on the roller shaft; and at least one mechanical connecter securing the at least one first roller handle to the roller shaft.

8. The modular workout solution as in claim 7, further comprising a second roller handle rotatably disposed on the roller shaft.

9. The modular workout solution as in claim 6, wherein the shaft has at least one of a coating or knurling adapted for enhancing a user's grip on the shaft.

10. The modular workout solution as in claim 6, further comprising an attachment lock integrated with at least one of the first hemisphere or the second hemisphere, the attachment lock being constructed and arranged to secure the attachment cap or a kettle bell handle within the attachment through hole such that the attachment lock must be depressed prior to removing the attachment cap or the kettle bell handle.

11. The modular workout solution as in claim 6, further comprising an attachment lock integrated with at least one of the first hemisphere or second hemisphere, the attachment lock being constructed and arranged to secure the attachment cap or kettle bell handle within the attachment through hole such that the attachment lock must be depressed prior to removing the cap or handle.

12. The modular workout solution as in claim 5, wherein the attachment assembly comprises at least one locking mechanism and at least one flange constructed and arranged for slidably engaging with at least one of the first hollow spine sleeve or the second hollow spine sleeve to secure the at least one modular weight within at least one of the first modular weight recess or the second modular recess.

13. The modular workout solution as in claim 5, wherein the at least one modular weight is a plurality of modular weights each includes a plurality of protrusions constructed and arranged to mechanically engage with one another when seated within the at least one of the first modular weight recess or second modular weight recess.

14. A modular workout solution, comprising:

a first hemisphere comprising a first hollow spine sleeve and defining a first attachment through hole in communication with the first hollow spine sleeve, the first hemisphere further defining a first modular weight recess constructed and arranged to seat at least one first modular weight therein;

a second hemisphere comprising a second hollow spine sleeve and defining a second attachment through hole in communication with the second hollow spine sleeve, the second hemisphere further defining a second modular weight recess constructed and arranged to seat at least one second modular weight therein;

an attachment assembly comprising at least one flange disposed between a first locking mechanism and a second locking mechanism, the first locking mechanism being disposed within the first hollow spine sleeve and the second locking mechanism being disposed within the second hollow spine sleeve, the attachment assembly being constructed and arranged to secure to the first hemisphere and second hemisphere;

at least one smart enabled assembly disposed within at least one of the first hemisphere or the second hemisphere, the at least one smart enabled assembly being constructed and arranged for monitoring and tracking user interactions with the modular workout solution and communicating said monitoring and tracking to a smart device; and wherein the at least one flange is constructed and arrange to secure the at least one first modular weight within the first modular weight recess and the at least one flange is constructed and arrange to secure the at least one second modular weight within the second modular weight recess.

15. The modular workout solution as in claim 1, further comprising at least one kettlebell handle constructed and arranged to seat within the first attachment through hole and securely attach to the attachment assembly and the first hemisphere.

16. A modular workout solution, comprising:

a first hemisphere comprising a first hollow spine sleeve and defining a first attachment through hole in communication with the first hollow spine sleeve;

a second hemisphere comprising a second hollow spine sleeve and defining a second attachment through hole in communication with the second hollow spine sleeve; and an attachment assembly disposed within the first hollow spine sleeve and the second hollow spine sleeve and the first attachment through hole and the second attachment through hole, the attachment assembly being constructed and arranged to secure to the first hemisphere and the second hemisphere.

17. The modular workout solution as in claim 16, wherein the first hemisphere further defines a first modular weight recess constructed and arranged to seat the at least one modular weight therein; and the second hemisphere further defines a second modular weight recess constructed and arranged to seat the at least one modular weight therein.

18. The modular workout solution as in claim 17, further comprising the at least one modular weight constructed and arranged to be selectively disposed within at least one of the first modular weight recess or the second modular weight recess.

19. The modular workout solution as in claim 16, further comprising a first attachment cap and a second attachment cap constructed and arranged to connectively seat within the first attachment through hole and the second attachment through hole, respectively, and securely attach to the attachment assembly and the first hemisphere and the second hemisphere.

20. The modular workout solution as in claim 5, wherein the attachment assembly comprises an integrated shaft constructed and arranged to space the first hemisphere from the second hemisphere.

* * * * *